US009771861B2

(12) United States Patent
McClearen et al.

(10) Patent No.: US 9,771,861 B2
(45) Date of Patent: Sep. 26, 2017

(54) OPPOSED PISTON TWO-STROKE ENGINE WITH THERMAL BARRIER

(71) Applicant: AVL Powertrain Engineering, Inc., Plymouth, MI (US)

(72) Inventors: James McClearen, Brighton, MI (US); Gary L. Hunter, Dexter, MI (US)

(73) Assignee: AVL POWERTRAIN ENGINEERING, INC., Plymouth, MI (US)

( * ) Notice: Subject to any disclaimer, the term of this patent is extended or adjusted under 35 U.S.C. 154(b) by 127 days.

(21) Appl. No.: 14/828,689

(22) Filed: Aug. 18, 2015

(65) Prior Publication Data

US 2016/0069293 A1 Mar. 10, 2016

Related U.S. Application Data

(60) Provisional application No. 62/047,813, filed on Sep. 9, 2014.

(51) Int. Cl.

| | |
|---|---|
| ***F02B 75/28*** | (2006.01) |
| ***F02B 75/02*** | (2006.01) |
| ***F02F 1/18*** | (2006.01) |

(52) U.S. Cl.

CPC ..... *F02B 75/02* (2013.01); *F02B 75/28* (2013.01); *F02F 1/186* (2013.01); *F02B 2075/025* (2013.01); *F05C 2251/048* (2013.01)

(58) Field of Classification Search

CPC .... F02B 75/02; F02B 75/28; F02B 2075/025; F02F 1/186; F05C 2251/048

(Continued)

(56) References Cited

U.S. PATENT DOCUMENTS 1,057,741 A * 4/1913 Keen ..... F04B 39/064 123/193.2
1,410,319 A † 3/1922 Junkers (Continued)

FOREIGN PATENT DOCUMENTS

DE 4335515 A1 † 4/1995
DE 102006060330 † 6/2008

(Continued)

OTHER PUBLICATIONS

Harry Indig, SAE 850362 Experimental Analysis of an Inwardly-Opposed Piston Engine, pp. 113-122, Feb. 25, 1985, Society of Automotive Engineers, Inc.†

*Primary Examiner* — Marguerite McMahon
(74) *Attorney, Agent, or Firm* — Harness, Dickey & Pierce, P.L.C.

(57) ABSTRACT

In one configuration, the present disclosure provides a cylinder including a first housing, a second housing, and an insert. The first housing includes a first body portion and a first collar portion. The first body portion has a first inner diameter, and the first collar portion has a second inner diameter that is greater than the first inner diameter. The second housing includes a second body portion and a second collar portion. The second body portion has a third inner diameter and the second collar portion has a fourth inner diameter that is greater than the third inner diameter. The second housing is coupled to the first housing such that the first and second collared portions cooperate to form an annular channel. The insert is disposed within the annular channel formed by the first and second collared portions.

25 Claims, 3 Drawing Sheets

(58) Field of Classification Search
USPC ..... 123/51 R–51 BD, 193.2
See application file for complete search history.

(56) References Cited

U.S. PATENT DOCUMENTS

| | | | | |
|---|---|---|---|---|
| 1,716,020 | A * | 6/1929 | Winckler | F02B 75/26 123/195 R |
| 2,144,706 | A † | 1/1939 | Pescara | |
| 2,423,395 | A † | 7/1947 | Lieberherr | |
| 2,446,841 | A † | 8/1948 | Lieberherr | |
| 3,082,752 | A † | 3/1963 | Thomas | |
| 3,911,891 | A † | 10/1975 | Dowell | |
| 4,471,017 | A † | 9/1984 | Poeschel | |
| 4,711,208 | A † | 12/1987 | Sander | |
| 5,236,787 | A † | 8/1993 | Grassi | |
| 5,320,909 | A † | 6/1994 | Scharman | |
| 5,384,200 | A † | 1/1995 | Giles | |
| 6,668,809 | B2 † | 12/2003 | Lowi | |
| 7,428,889 | B2 † | 9/2008 | Salzgeber | |
| 8,087,389 | B2 | 1/2012 | Lemke et al. | |
| 8,485,147 | B2 † | 7/2013 | Liu | |
| 8,550,041 | B2 | 10/2013 | Lemke et al. | |
| 8,935,998 | B1 | 1/2015 | Tebbe | |
| 9,121,365 | B1 | 9/2015 | Wagner | |
| 2007/0000468 | A1 † | 1/2007 | Azevedo | |
| 2013/0327289 | A1 † | 12/2013 | Hiratsuka | |
| 2014/0026864 | A1 | 1/2014 | Lemke et al. | |
| 2014/0090625 | A1 † | 4/2014 | Dion | |
| 2014/0102418 | A1 * | 4/2014 | Babu | F01B 7/14 123/51 R |

FOREIGN PATENT DOCUMENTS

| | | | |
|---|---|---|---|
| DE | 202012000275 | U1 † | 3/2012 |
| EP | 2108798 | A2 † | 10/2009 |
| EP | 1474594 | B1 † | 8/2012 |
| JP | 58193030 | U1 † | 12/1983 |
| JP | 59094148 | U1 † | 6/1984 |
| JP | 61159644 | U1 † | 10/1986 |
| JP | H08284666 | A † | 10/1996 |
| JP | 62038458 | U1 † | 11/2002 |
| JP | 2014092035 | A † | 5/2014 |

* cited by examiner
† cited by third party

OPPOSED PISTON TWO-STROKE ENGINE WITH THERMAL BARRIER

CROSS-REFERENCE TO RELATED APPLICATIONS

This application claims the benefit of U.S. Provisional Application No. 62/047,813, filed on Sep. 9, 2014. The entire disclosure of the above application is incorporated herein by reference.

FIELD

The present disclosure relates to an opposed-piston engine and more particularly to an opposed-piston two-stroke engine including at least one thermal barrier.

BACKGROUND

This section provides background information related to the present disclosure and is not necessarily prior art.

Opposed-piston engines include two pistons housed within a single cylinder that move in an opposed, reciprocal manner within the cylinder. In this regard, during one stage of operation, the two pistons are moving away from one another within the cylinder. During another stage of operation, the two pistons are moving towards one another within the cylinder.

As the pistons move towards one another within the cylinder, they compress and, thus, cause the ignition of a fuel disposed within the cylinder. When the fuel ignites, it generates heat within the cylinder.

Heat generated by an opposed-piston engine can be dissipated and/or minimized in a variety of ways. For example, cooling systems that include components such as radiators, coolants, and/or fans can be used to transfer heat from the engine to the environment. Such components are typically sized to accommodate the thermal load of the particular engine. Accordingly, engines that generate more heat during operation typically require larger cooling-system components. Such larger components—while adequately cooling the engine during operation—add to the overall cost, weight, and complexity of the cooling system and, thus, to the vehicle in which the engine and cooling system are installed.

While known opposed-piston engines have generally proven to be acceptable for their intended purposed, a continued need in the relevant art remains

SUMMARY

This section provides a general summary of the disclosure, and is not a comprehensive disclosure of its full scope or all of its features.

In one configuration, the present disclosure provides a cylinder including a first housing, a second housing, and an insert. The first housing includes a first body portion and a first collar portion. The first body portion has a first inner diameter and the first collar portion has a second inner diameter that is greater than the first inner diameter. The second housing includes a second body portion and a second collar portion. The second body portion has a third inner diameter, and the second collar portion has a fourth inner diameter that is greater than the third inner diameter. The second housing is coupled to the first housing such that the first and second collared portions cooperate to form an annular channel. The insert is disposed within the annular channel formed by the first and second collared portions.

In another configuration, the present disclosure provides an opposed-piston engine including a first housing, a second housing, a first piston, a second piston, and a liner. The first housing includes a first inner surface defining a first chamber. The second housing is coupled to the first housing and includes a second inner surface defining a second chamber. The first piston is slidably disposed within the first chamber. The second piston is slidably disposed within the second chamber. The liner is coupled to at least one of the first housing and the second housing and includes a third inner surface defining a third chamber in fluid communication with the first chamber and the second chamber to allow the first piston and the second piston to slide within the liner.

In another configuration, the present disclosure provides an opposed-piston engine including a first housing, a second housing, a first piston, a second piston, a duct, and a ceramic liner. The first housing includes a first inner surface defining a first chamber. The second housing is coupled to the first housing and includes a second inner surface and at least one port. The second inner surface defines a second chamber in fluid communication with the at least one port. The first piston is slidably disposed within the first chamber. The second piston is slidably disposed within the second chamber. The duct includes a third inner surface defining a third chamber in fluid communication with the at least one port whereby the ceramic liner is coupled to the third inner surface.

In another configuration, the present disclosure provides a piston including a first portion formed from a first material and a second portion formed from a second material. The first portion defines a substantially cylindrical construct extending from a first end to a second end and defines a first outer diameter. The second portion is coupled to the first end of the first portion and defines a second outer diameter that is substantially equal to the first diameter. The first material absorbs heat at a first rate while the second material absorbs heat at a second rate that is less than the first rate.

In yet another configuration, the present disclosure provides a piston including a first portion, a second portion, and a third portion. The third portion is disposed between the first portion and the second portion and includes a different material than the first portion and the second portion. The third portion has an outer surface that is substantially flush with an outer surface of the first portion and an outer surface of the second portion.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
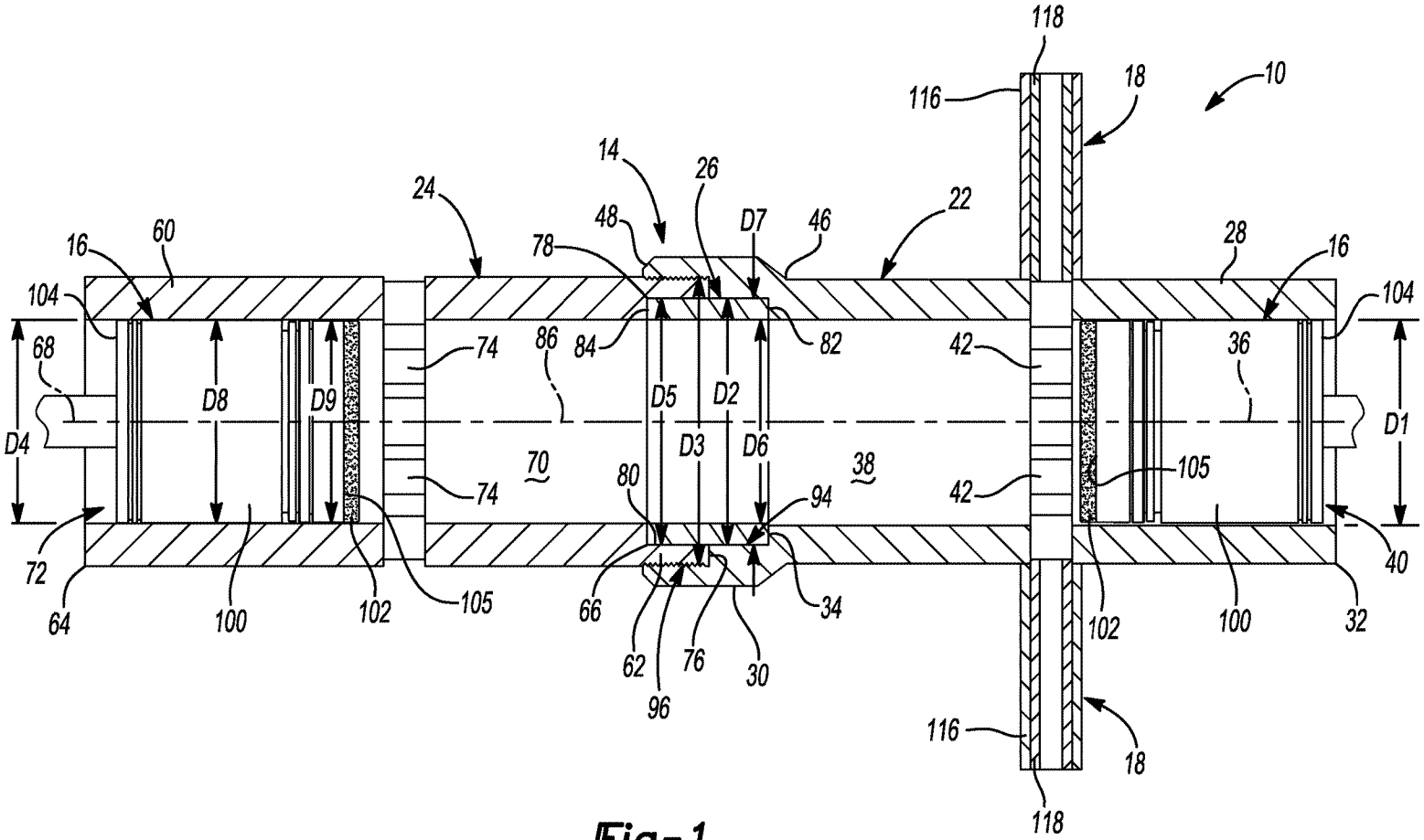
FIG. 1 is a partial cross-sectional view of an opposed-piston engine in accordance with the principles of the present disclosure.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
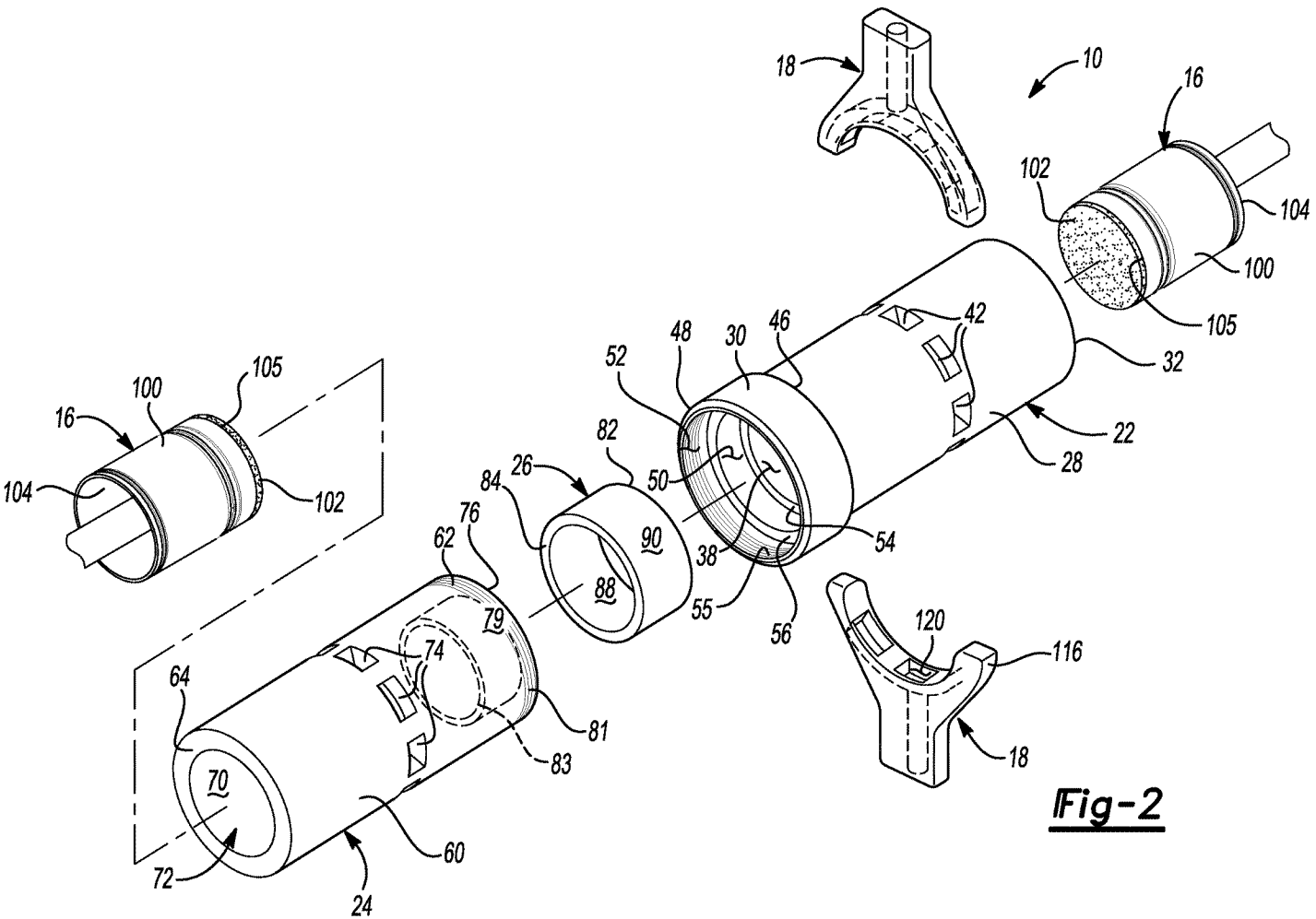
FIG. 2 is a an exploded perspective view of the opposed-piston engine of FIG. 1.

With reference to FIGS. 1 and 2, an engine 10 is provided. In one configuration, the engine 10 may be an opposed-piston, two-stroke diesel engine for use in a vehicle or other machine. It will be appreciated, however, that the engine 10 may have other configurations such as an internal combustion engine or a free-piston engine within the scope of the present disclosure.

The engine 10 may include a cylinder 14, at least one piston 16, and an exhaust duct 18. While only one cylinder 14 is shown, it will be appreciated that the engine 10 may include any number of cylinders 14, each including at least one piston 16, as is known in the art.

The cylinder 14 may include a first housing 22, a second housing 24, and an insert or liner element 26. The first and second housings 22, 24 may be formed from a first material having a first heat transfer coefficient h1. In one configuration, the first material may be iron, steel, or a suitable metallic alloy.

The first housing 22 may include a first body portion 28 and a first collar portion 30. While the first body portion 28 and the first collar portion 30 are described herein as being separate portions of the first housing 22, it will be appreciated that the first body and collar portions 28, 30 may be integrally formed such that the first housing 22 is a monolithic construct.

The first body portion 28 may extend between a first end 32 and a second end 34 along a first central axis 36. The first and second ends 32, 34 may be open ends such that a first inner surface 38 of the first body portion 28 defines a first chamber 40. The first inner surface 38 and, thus, the first chamber 40, may be generally cylindrical, defining a first inner diameter D1. The first body portion 28 may include a plurality of radially extending first ports 42 located between the first and second ends 32, 34. In one configuration, the first ports 42 may be outlet ports for transporting a combustion exhaust from the first chamber 40 to the exhaust system. As illustrated, the first ports 42 may be circumferentially arranged about the first body portion 28.

The first collar portion 30 may extend between a first end 46 and a second end 48 along the first central axis 36. The first collar portion 30 may include a second inner surface 50 and a third inner surface 52 (FIG. 2). The second inner surface 50 may extend from and between the first inner surface 38 and the third inner surface 52 and may define a second diameter D2 that is greater than the first diameter D1. The third inner surface 52 may extend from the second inner surface 50 and may define a third diameter D3 that is greater than the second diameter D2. In this regard, the first and second inner surfaces 38, 50 may cooperate to define a first annular shoulder 54, while the second and third inner surfaces 50, 52 may cooperate to define a second annular shoulder 56. In some configurations, the third inner surface 52 may include a first threaded portion 55.

The second housing 24 may include a second body portion 60 and a second collar portion 62. While the second body portion 60 and the second collar portion 62 are described herein as being separate portions of the second housing 24, it will be appreciated that the second body and collar portions 60, 62 may be integrally formed such that the second housing 24 is a monolithic construct.

The second body portion 60 may extend between a first end 64 and a second end 66 along a second central axis 68. The first and second ends 64, 66 may be open ends such that a fourth inner surface 70 of the second body portion 60 defines a second chamber 72. The fourth inner surface 70 and, thus, the second chamber 72, may be generally cylindrical, defining a fourth diameter D4 that is substantially equal to the first diameter D1. The second body portion 60 may include a plurality of radially extending second ports 74 located between the first and second ends 64, 66. In one configuration, the second ports 74 may be inlet ports for transporting a fuel, such as diesel fuel, from a fuel system (not shown) to the second chamber 72. As illustrated, the second ports 74 may be circumferentially arranged about the second body portion 60.

The second collar portion 62 may extend between a first end 76 and a second end 78 along the second central axis 68. The second collar portion 62 may include a fifth inner surface 80. The fifth inner surface 80 may extend from the fourth inner surface 70 and may define a fifth diameter D5 that is greater than the fourth diameter D4 and substantially equal to the second diameter D2. In this regard, the fourth and fifth inner surfaces 70, 80 may cooperate to define a third annular shoulder 83 (FIG. 2). In some configurations, an outer surface 79 of the second collar portion 62 may include a second threaded portion 81.

The liner element 26 may be a substantially cylindrical construct extending between a first end 82 and a second end 84 along a third central axis 86. The liner element 26 may include a sixth inner surface 88 defining a sixth diameter D6 and a first outer surface 90 defining a seventh diameter D7. The sixth diameter D6 may be substantially equal to the first and fourth diameters D1, D4. The seventh diameter D7 may be substantially equal to, or slightly less than, the second and fifth diameters D2, D5.

The liner element 26 may be formed from a second material having a second heat transfer coefficient h2. The second material may be a ceramic material such that the second heat transfer coefficient h2 is less than the first heat transfer coefficient h1. In one configuration, the second material may be zirconia, or other material whose coefficient of thermal expansion is substantially equal to a coefficient of thermal expansion for steel. Accordingly, a rate of heat transfer through the second material of the liner element 26 is less than a rate of heat transfer through the first material of the first and second housings 22, 24. In this regard, as the engine 10 produces exhaust gases, the second material of the liner element 26 allows for an increased temperature of the exhaust gases within the cylinder 14. Accordingly, less heat is rejected to a cooling system (not shown) of the engine 10 and, thus, a size of the cooling system can be reduced.

In an assembled configuration, the liner element 26 is located within the cylinder 14. In this regard, the second housing 24 may be coupled to the first housing 22 such that the first end 76 abuts, or is otherwise adjacent to, the second annular shoulder 56. The first annular shoulder 54 and the third annular shoulder 83 may cooperate with the second inner surface 50 and the fifth inner surface 80 to define an annular channel 94 in the cylinder 14. In one configuration, the first threaded portion 55 of the third inner surface 52 may be threadably coupled to the second threaded portion 81 of the outer surface 79. It will be appreciated, however, that the third inner surface 52 may be coupled to the outer surface 79 using other fastening techniques such as, for example, welding, press-fitting, and mechanical fasteners.

In the assembled configuration, the liner element 26 may be located within the channel 94. In this regard, the first outer surface 90 may be coupled to and/or oppose the second inner surface 50 and the fifth inner surface 80. The first end 82 of the liner element 26 may abut, or otherwise be adjacent to, the first annular shoulder 54, and the second end 84 may abut, or otherwise be adjacent to, the third annular shoulder 83. In this way, the liner element 26 may overlap a junction 96 of the first and second housings 22, 24 such that the liner element 26 is concentrically disposed within the first threaded portion 55 and the second threaded portion 81. The third central axis 86 may be substantially aligned with the first and second central axes 36, 68 such that the first, fourth, and sixth inner surfaces 38, 70, 88 are substantially flush, or otherwise aligned, with another.

As illustrated in FIG. 1, in one configuration, the engine 10 may include two pistons 16. In an assembled configuration, a first piston 16 may be slidably disposed in the first housing 22 and a second piston 16 may be slidably disposed in the second housing 24.

Figure 3B:
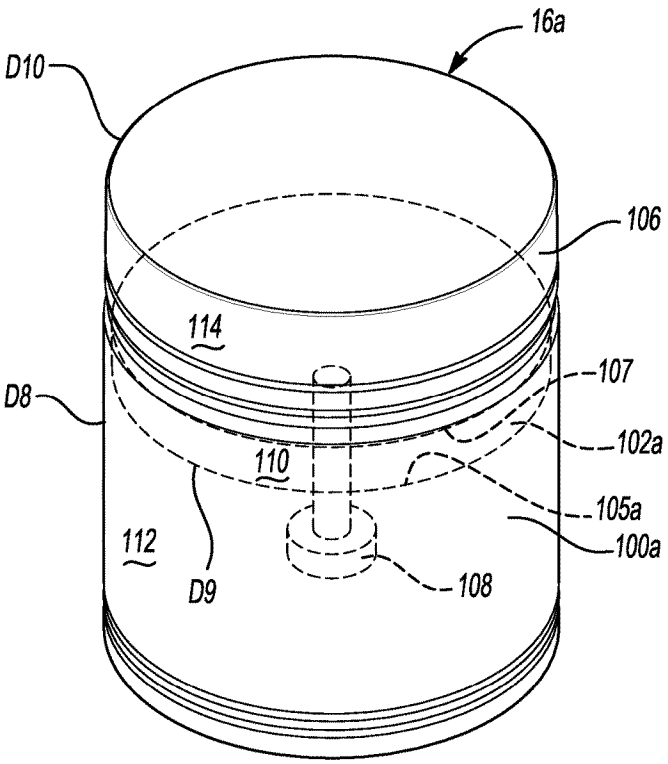
FIG. 3B is a perspective view of another configuration of a piston of the opposed-piston engine of FIG. 1.
Figure 3A:
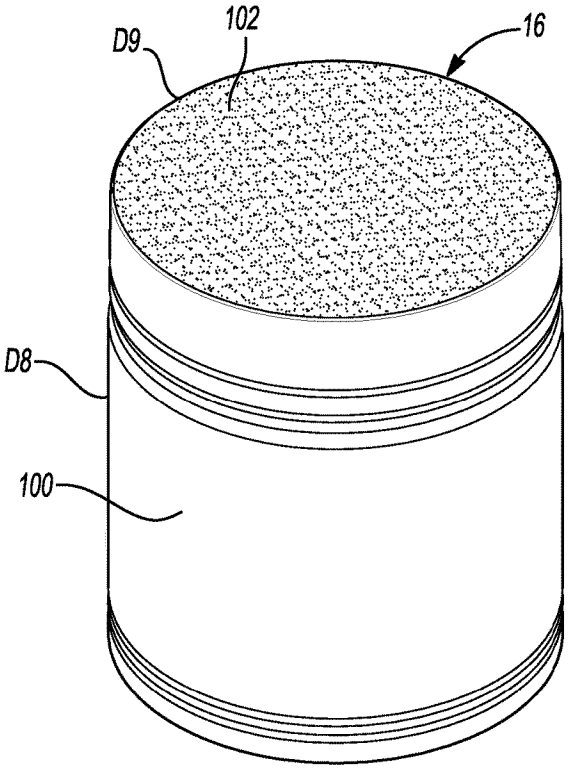
FIG. 3A is a perspective view of a piston of the opposed-piston engine of FIG. 1.

With reference to FIG. 3A, the piston 16 may include a first portion 100 and a second portion 102. The first portion 100 may be a substantially cylindrical construct extending between a first end 104 and a second end 105 that defines an eighth diameter D8. The first portion 100 may include a material having a third heat transfer coefficient h3.

The second portion 102 may be coupled to the second end 105 of the first portion 100 using various fastening techniques such as laser welding, mechanical fasteners, and/or chemical adhesion, for example. The second portion 102 may include a substantially cylindrical construct defining a ninth diameter D9. The ninth diameter D9 may be substantially equal to the eighth diameter D8. In this regard, the second portion 102 may form a layer or coating on the second end 105 of the first portion 100. The second portion 102 may have a thickness (t) between approximately two millimeters and approximately six millimeters. In one configuration, the thickness (t) may be substantially equal to approximately four millimeters.

The second portion 102 may include a material having a fourth heat transfer coefficient h4. The material of the second portion 102 may be a ceramic material such that the fourth heat transfer coefficient h4 is less than the third heat transfer coefficient h3. In one configuration, the material of the second portion 102 is zirconia, or other material whose coefficient of thermal expansion is substantially equal to the coefficient of thermal expansion for steel. Accordingly, a rate of heat transfer through the material of the second portion 102 is less than a rate of heat transfer through the material of the first portion 100 such that the second portion 102 forms a thermal barrier coating on the second end 105 of the first portion 100. In this regard, as the engine 10 produces exhaust gases, the second portion 102 allows for an increased temperature of the exhaust gases within the cylinder 14. Accordingly, less heat is rejected to a cooling system (not shown) of the engine 10 and, thus, a size of the cooling system can be reduced With reference to FIG. 3B, another configuration of a piston 16*a* is shown. In view of the substantial similarity in structure and function of the piston 16 with respect to the piston 16*a*, like reference numerals are used hereinafter and in the drawings to identify like components while like reference numerals containing letter extensions are used to identify those components that have been modified.

The piston 16*a* may include a first portion 100*a*, a second portion 102*a*, and a third portion 106. At least one of the first and third portions 100*a*, 106 may include the material having the third heat transfer coefficient h3. In one configuration, the first and third portions 100*a*, 106 include the material having the third heat transfer coefficient h3. The second portion 102*a* may include the material having the fourth heat transfer coefficient h4 and may be disposed between the first portion 100*a* and the third portion 106. In this regard, the second portion 102*a* may be coupled to the second end 105*a* of the first portion 100*a* and to a first end 107 of the third portion 106. The second portion 102*a* may be coupled to either or both of the second end 105*a* and the first end 107 using various fastening techniques such as laser welding, mechanical fasteners (e.g., bolts 108), and/or chemical adhesion, for example.

The ninth diameter D9 of the second portion 102*a* may be substantially equal to the eighth diameter D8 of the first portion 100*a* and to a tenth diameter D10 of the third portion 106 such that an outer surface 110 of the second portion 102*a* is substantially flush with an outer surface 112 of the first portion 100 and with an outer surface 114 of the third portion 106.

The exhaust duct 18 may be in fluid communication with the first ports 42 of the first housing 22. In this regard, the exhaust duct 18 may remove or otherwise transport exhaust gas from the first chamber 40 through the first ports 42. The exhaust duct 18 may include a first portion 116 and a second portion 118. The second portion 118 is coupled to an inner surface 120 of the first portion 116, as will be described below. The first portion 116 may include a material having a fifth heat transfer coefficient h5.

The second portion 118 may be coupled to the first portion 116 using various fastening techniques such as laser welding or chemical adhesion, for example. In this regard, the second portion 118 may form a layer or coating on the inner surface 120 of the first portion 116. The second portion 118 may have a thickness t1 between approximately three tenths of a millimeter and seven tenths of a millimeter. In one configuration, the thickness t1 may be substantially equal to approximately five tenths of a millimeter.

The second portion 118 may include a material having a sixth heat transfer coefficient h6. The material of the second portion 118 may be a ceramic material such that the sixth heat transfer coefficient h6 is less than the fifth heat transfer coefficient h5. In one configuration, the material of the second portion 118 is zirconia, or other material whose coefficient of thermal expansion is substantially equal to the coefficient of thermal expansion for steel. In this regard, the second portion 118 may also include a bonding base material. Accordingly, a rate of heat transfer through the material of the second portion 118 is less than a rate of heat transfer through the material of the first portion 116 such that the second portion 118 forms a thermal barrier coating on the inner surface 120 of the first portion 116. In this regard, as the engine 10 produces exhaust gases, the second portion 118 allows for an increased temperature of the exhaust gases within the cylinder 14. Accordingly, less heat is rejected to a cooling system (not shown) of the engine 10 and, thus, a size of the cooling system can be reduced.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A cylinder, comprising:

a first housing including a first body portion and a first collar portion, the first body portion having a first inner surface defining first inner diameter, the first collar portion having a second inner surface defining a second inner diameter that is greater than the first inner diameter;

a second housing including a second body portion and a second collar portion, the second body portion having a third inner surface defining a third inner diameter, the second collar portion having a fourth inner surface defining a fourth inner diameter that is greater than the third inner diameter, wherein the second housing is coupled to the first housing such that the second and fourth inner surfaces of the first and second collar portions cooperate with one another to at least partially form an annular channel; and an insert disposed within the annular channel formed by the second and fourth inner surfaces of the first and second collar portions.

2. The cylinder of claim 1, wherein first and second housings are formed from a first material having a first heat transfer coefficient and the insert is formed from a second material having a second heat transfer coefficient that is less than the first heat transfer coefficient.

3. The cylinder of claim 1, wherein the insert is constructed from a ceramic.

4. The cylinder of claim 3, wherein the ceramic is zirconia.

5. The cylinder of claim 1, wherein the first housing and the second housing overlap one another at a junction of the first collar portion and the second collar portion.

6. The cylinder of claim 5, wherein the insert overlaps the junction.

7. The cylinder of claim 5, wherein the first housing is attached to the second housing at the junction.

8. The cylinder of claim 7, wherein the first collar portion includes a first series of threads and the second collar portion includes a second series of threads, the first series of threads engaging the second series of threads to attach the first housing to the second housing.

9. The cylinder of claim 1, wherein the first housing includes a first threaded portion and the second housing includes a second threaded portion, the first threaded portion being threadably coupled to the second threaded portion to attach the first housing to the second housing.

10. The cylinder of claim 9, wherein the first threaded portion is a threaded inner surface of the first housing and the second threaded portion is a threaded outer surface of the second housing.

11. The cylinder of claim 9, wherein the insert is concentrically disposed within the first threaded portion and the second threaded portion.

12. The cylinder of claim 1, wherein the first body portion defines a first plurality of ports arranged circumferentially about the first body portion, and the second body portion defines a second plurality of ports arranged circumferentially about the second body portion.

13. The cylinder of claim 1, wherein the first body portion of the first housing has a first end defining a first axial end surface, the second body portion of the second housing has a second end defining a second axial end surface opposing the first axial end surface of the first housing, and the first and second axial end surfaces of the first and second housings cooperate with the second and fourth inner surfaces of the first and second housing to form the annular channel.

14. An opposed-piston engine, comprising:

a first housing including a first inner surface defining a first chamber;

a second housing coupled to the first housing and including a second inner surface defining a second chamber;

a first piston slidably disposed within the first chamber;

a second piston slidably disposed within the second chamber; and a liner coupled to at least one of the first housing and the second housing, the liner including a third inner surface defining a third chamber in fluid communication with the first chamber and the second chamber, the liner being both axially aligned with and disposed radially inward of a portion of at least one of the first and second housings, wherein the first and second pistons are operable to slide within the liner.

15. The opposed-piston engine of claim 14, wherein the first inner surface defines a first diameter, the second inner surface defines a second diameter that is substantially equal to the first diameter, and the third inner surface defines a third diameter that is substantially equal to the first diameter and the second diameter.

16. The opposed-piston engine of claim 15, wherein the first inner surface, the second inner surface, and the third inner surface are coaxial.

17. The opposed-piston engine of claim 15, wherein the first inner surface, the second inner surface, and the third inner surface are substantially flush with one another.

18. The opposed-piston engine of claim 15, wherein the first housing includes a first collar portion having a fourth inner surface defining a fourth diameter that is greater than the first diameter, and wherein the liner is coupled to the fourth inner surface.

19. The opposed-piston engine of claim 18, wherein the second housing includes a second collar portion having a fifth inner surface defining a fifth diameter that is greater than the second diameter, and wherein the liner is coupled to the fifth inner surface.

20. The opposed-piston engine of claim 19, wherein the fourth diameter is substantially equal to the fifth diameter.

21. The opposed-piston engine of claim 14, wherein the first housing and the second housing cooperate to define an annular channel, the liner being disposed within the annular channel.

22. The opposed-piston engine of claim 21, wherein the first inner surface defines a first diameter, the second inner surface defines a second diameter that is substantially equal to the first diameter, and the third inner surface defines a third diameter that is substantially equal to the first diameter and the second diameter.

23. The opposed-piston engine of claim 14, wherein the liner is both axially aligned with and disposed radially inward of a first portion of the first housing and a second portion of the second housing.

24. The opposed-piston engine of claim 19, wherein the fourth and fifth inner surfaces of the first and second collar portions cooperate with one another to at least partially form an annular channel, and the liner is disposed in the annular channel.

25. The opposed-piston engine of claim 19, wherein the first housing and the second housing overlap one another at a junction of the first collar portion and the second collar portion.

* * * * *